United States Patent [19]

Rudolph et al.

[11] B 3,982,933

[45] Sept. 28, 1976

[54] BRASS ALLOY

[75] Inventors: Günther Rudolph, Neuberg; Erhard Schelzke, Neu-Isenburg; Antonio Leogrande, Werdohl, all of Germany

[73] Assignee: Vereinigte Deutsche Metallwerke AG, Frankfurt am Main, Germany

[22] Filed: Oct. 31, 1973

[21] Appl. No.: 411,471

[44] Published under the second Trial Voluntary Protest Program on February 17, 1976 as document No. B 411,471.

[30] Foreign Application Priority Data

Nov. 2, 1972 Germany ..... 2253690

[52] U.S. Cl. ..... 75/156.5; 75/154

[51] Int. Cl.[2] ..... C22C 9/04

[58] Field of Search ..... 75/156, 156.5, 157, 75/157.5, 163

[56] References Cited

UNITED STATES PATENTS 3,158,470 11/1964 Burghoff et al. ..... 75/157.5 X

OTHER PUBLICATIONS

Bridgeport Brass Technical Handbook, Sept. 1949, Bridgeport Brass Co., Conn., pp. 64 and 65.

Metals and Alloys, 1950, Chemical Pub. Co., N.Y., p. 51.

*Primary Examiner*—C. Lovell

*Attorney, Agent, or Firm*—Karl F. Ross; Herbert Dubno

[57] ABSTRACT

A brass alloy consisting essentially of 57 to 62% by weight copper, 1 to 4% by weight lead and the balance zinc has improved machinability in terms of allowing high coating speeds or affording reduced coating tool wear, especially when the alloy is machined upon an automatic lathe, by the inclusion therein of 0.15 to 0.20% by weight each of tin and magnesium.

5 Claims, 1 Drawing Figure

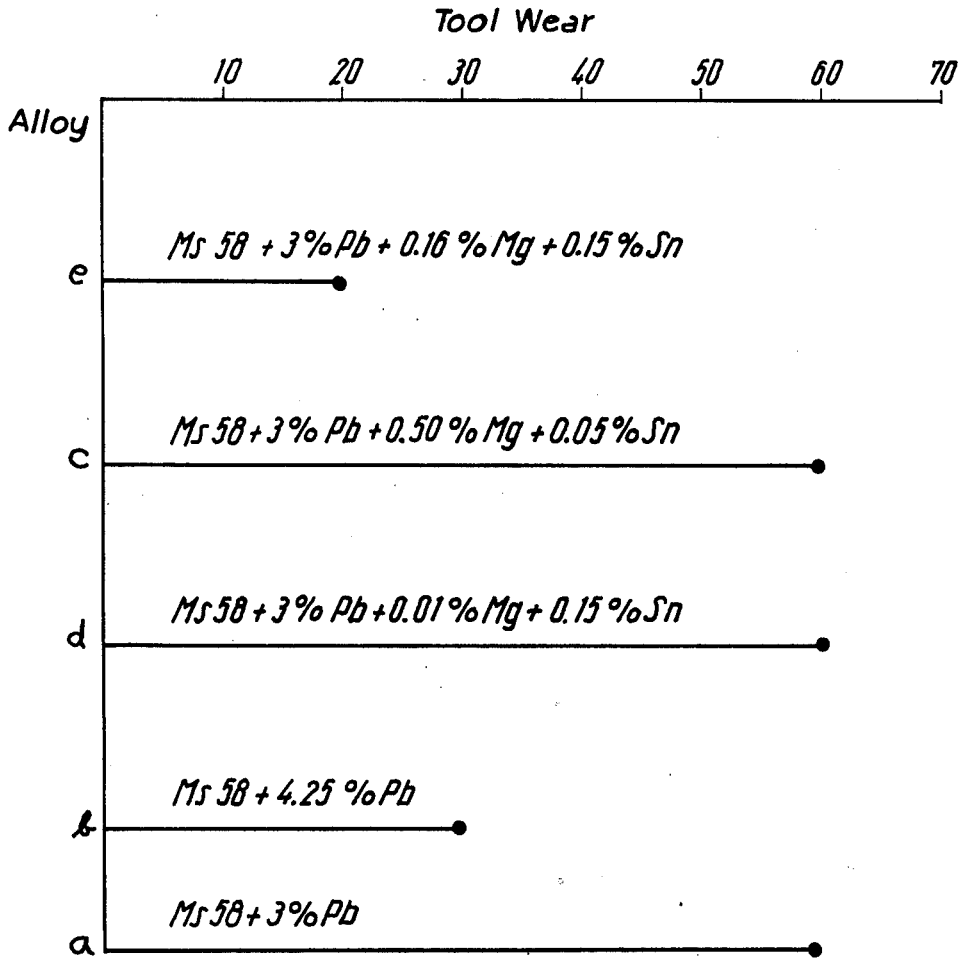
Tool Wear
10
20
30
40
50
60
70
Alloy
e
Ms 58 + 3% Pb + 0.16 % Mg + 0.15 % Sn
c
Ms 58 + 3% Pb + 0.50 % Mg + 0.05 % Sn
d
Ms 58 + 3% Pb + 0.01 % Mg + 0.15 % Sn
b
Ms 58 + 4.25 % Pb
a
Ms 58 + 3% Pb

BRASS ALLOY

FIELD OF THE INVENTION

The present invention relates to a brass alloy with improved machinability and expressly suited for machining on automatic lathes and like machine tools.

BACKGROUND OF THE INVENTION

In the machining of conventional brass alloys which consist of 57–62% by weight copper, 1–4% by weight lead, balance zinc, and which are known as free-cutting brass alloys, the increasing use of automatic lathes imposes increasingly more stringent requirements as regards the machinability of such alloys and particularly as regards the edge life of the tool. The machinability is defined either by the edge life of the tool when used for a defined machining operation or by the increase of the cutting speed which results in a given edge life of the tool. In view of the urge toward higher efficiency, the edge life of the tool must be increased and all possiblities regarding the material must be utilized in order to develop free-cutting brass alloys which have the required strength and result in a minimum wear of the tool and in a maximum edge life of the tool.

For this purpose it is known to use a free-cutting brass alloy, which differs in composition from the conventional free-cutting brass alloy Cu45 Zn39 Pb3 only by a higher lead content of 4.25% by weight rather than 3.25% by weight. The increased lead content results in an improved machinability, giving a tool edge life which is 2.5 to 4 times longer at a given cutting speed or permitting an increase of the cutting speed by as much as 33% for a given edge life of the tool. That brass alloy has the significant disadvantage that the increased lead content adversely affects the mechanical properties of the alloy, particularly its strength and hardness, so that the alloy cannot be used in all cases to make highly stressed machine elements such as thin-walled elements having internal screw threads.

A lead-containing brass alloy has beed proposed which is subjected to a treatment to reduce the content of silicon dioxide and zinc sulfide inclusions and which contains a reagent metal which consists of at least one of the following components: Magnesium in an amount of 0.01–0.3% by weight, calcium in an amount of 0.001–0.05% by weight, sodium and/or potassium in an amount of 0.0001–0.0005% by weight, and mischmetal in an amount of about 0.14%. It has been found that the machinability of this brass alloy is not better than that of the conventional brass alloy Cu58 Zn39 Pb3.

OBJECT OF THE INVENTION

It is an object of the present invention to provide a free-cutting brass alloy which distinguished by an improved machinability and particularly as regards strength and hardness has improved mechanical properties.

DESCRIPTION OF THE INVENTION

According to the invention this object is accomplished by a brass alloy which is composed of

| | |
|---|---|
| 57–62%, preferably 57.5–59.5% | copper |
| 1–4%, preferably 1–3% | lead |
| 0.15–0.20% | magnesium |
| 0.15–0.20% | tin |
| balance | zinc. |

The invention thus comprises a brass alloy consisting essentially of 57 to 62% by weight copper, 1 to 4% by weight lead, 0.15 to 0.20% by weight magnesium, 0.15 to 0.20% by weight tin and the balance zinc. Preferably the copper content is 57.5 to 59.5% by weight and the lead content is 1 to 3% by weight. The alloy has high structural strength and good machinability in terms of reduced tool wear or increased coating speeds, especially when machined upon an automatic lathe.

DESCRIPTION OF THE DRAWING

The above and other objects, features and advantages of the present invention will be more readily apparent from the following description, and specific examples, reference being made to the sole FIGURE of the accompanying drawing in which is a diagram or bar graph of the tool wear for a number of alloys. In the diagram, Ms58 represents a commercial brass containing about 58% by weight copper to 39% by weight zinc.

SPECIFIC EXAMPLES

In the drawing the results of experiments are compared which were carried out with five brass alloys on an automatic lathe at a constant cutting speed of 280 meters per minute. The following brass alloys were tested (all percents by weight):

a. Cu58 Zn39 Pb3;
b. Cu58 Zn39 containing 4.25% lead;
c. Cu58 Zn39 Pb3 containing 0.05% tin and 0.5% magnesium;
d. Cu58 Zn39 Pb3 containing 0.15% tin and 0.01% magnesium;
e. Cu58 Zn39 Pb3 containing 0.16% magnesium and 0.15% tin in accordance with the invention.

The approximate figures for the abrasion value were determined by a short-time radioactive machining test, in which the workpiece is machined with a tool which has been activated in a reactor and the radiation is measured which is emitted by the activated particles which adhere to the chips in an amount of 90%. The measurable pulse rate may be considered as a relative measure of the wear or erosion of the tool. This method involves an integration over several rates of abrasion, such as the abrasion over the back face and the abrasion by detached chips. The method has the great advantage that the tests are of very short duration and can be carried out at the cutting speeds which are conventional in a workshop. For this reason the figures for the abrasion resistance can be directly used in practice whereas with other short-time tests using extremely high cutting speeds this is possible only by extrapolation.

The comparison of the approximate abrasion values shows clearly that as regards tool wear the brass alloy according to the invention is superior to the free-cutting brass alloys which are known in the art whereas the mechanical properties which are required in practice are not adversely affected.

We claim:

1. A brass alloy with improved machinability consisting essentially of 57 to 62% by weight copper, 1 to 4% by weight lead, 0.15 to 0.20% by weight magnesium, 0.15 to 0.20% by weight tin and the balance zinc.

2. The alloy defined in claim 1 which contains copper in an amount of 57.5 to 59.5% by weight.

3. The alloy defined in claim 2 which contains lead in an amount of 1 to 3% by weight.

4. The alloy defined in claim 1 which consists essentially of Cu58, Zn39, Pb3 brass containing 0.15 to 0.20% by weight magnesium and 0.15 to 0.20% by weight tin.

5. The alloy defined in claim 4 which contains 0.16% magnesium and 0.15% tin.

* * * * *